US006715582B2

(12) United States Patent
Nissen et al.

(10) Patent No.: US 6,715,582 B2
(45) Date of Patent: Apr. 6, 2004

(54) SUCTION MUFFLER

(75) Inventors: Jens Erik Nissen, Hvedemarken (DE); Christian Svendsen, Vestervang (DE)

(73) Assignee: Danfoss Compressors GmbH, Flensburg (DE)

( * ) Notice: Subject to any disclaimer, the term of this patent is extended or adjusted under 35 U.S.C. 154(b) by 32 days.

(21) Appl. No.: 10/093,777

(22) Filed: Mar. 8, 2002

(65) Prior Publication Data

US 2002/0134617 A1 Sep. 26, 2002

(30) Foreign Application Priority Data

Mar. 23, 2001 (DE) ..... 101 14 327

(51) Int. Cl.[7] ..... F04B 39/16

(52) U.S. Cl. ..... 181/231; 181/262; 417/312; 417/430; 417/572

(58) Field of Search ..... 181/212, 262, 181/214, 220, 221, 224, 231, 232, 256, 254

(56) References Cited

U.S. PATENT DOCUMENTS 4,022,550 A * 5/1977 Brink et al. ..... 417/234
4,911,619 A 3/1990 Todescat et al. ..... 417/312
5,252,035 A 10/1993 Lee ..... 417/312
5,562,427 A * 10/1996 Mangyo et al. ..... 417/313

FOREIGN PATENT DOCUMENTS

| | | | |
|---|---|---|---|
| DE | 24 51 524 | 5/1976 | ..... F25B/43/00 |
| DE | 42 39 575 A1 | 5/1994 | ..... F04B/39/12 |
| DE | 199 23 734 A1 | 11/2000 | ..... F04B/39/12 |
| EP | 0 386 320 A1 | 9/1990 | ..... F04B/39/12 |
| EP | 1 031 728 A1 | 8/2000 | ..... F04B/39/12 |

* cited by examiner

*Primary Examiner*—Robert Nappi
*Assistant Examiner*—David Warren
(74) *Attorney, Agent, or Firm*—McCormick, Paulding & Huber LLP

(57) ABSTRACT

The invention relates to a suction muffler for a hermetically enclosed compressor, with a housing having a first part with an outlet channel and a second part with an inlet channel, flow conducting means being arranged between the outlet channel and the inlet channel, said means forming, together with the inlet channel and the outlet channel, a flow path, and a filter being arranged in the outlet channel.

Further improvements of the noise damping are endeavored.

For this purpose, the filter has a sieve-like embodiment and that the flow path comprises at least one second filter with a sieve-like embodiment.

11 Claims, 1 Drawing Sheet

SUCTION MUFFLER

CROSS-REFERENCE TO RELATED APPLICATIONS

This application is entitled to the benefit of and incorporates by reference essential subject matter disclosed in German Patent Application No. 101 14 327.3 filed on Mar. 23, 2001 in the name of Danfoss Compressors GmbH.

FIELD OF THE INVENTION

The invention relates to a suction muffler for a hermetically enclosed compressor, with a housing having a first part with an outlet channel and a second part with an inlet channel, flow conducting means being arranged between the outlet channel and the inlet channel, said means forming, together with the inlet channel and the outlet channel, a flow path, and a filter being arranged in the outlet channel.

BACKGROUND OF THE INVENTION

A suction muffler of this kind is known from DE 199 23 734 A1.

Such suction mufflers are preferably used in hermetically enclosed small refrigeration machines, for example like those used in domestic refrigerators and freezers. Such appliances are usually placed in the kitchen or another room in an apartment. They are supposed to work as silently as possible, in order not to interfere with the comfort of an occupant. Therefore, flow conducting means are used to form a flow path for the gaseous refrigerant between an inlet and an outlet chamber. The flow path is shaped so that the movement of the refrigerant generates as little noise as possible. In the prior art, the flow conducting means divides a housing having a first part with the outlet chamber and a second part with the inlet chamber into two chambers, the gas reserves in the chamber connected with the outlet channel have a buffer function, whereas the inlet-side chamber provides an oil trap, meaning that oil gathering here contributes to the noise damping.

Additional suction mufflers are known from U.S. Pat. Nos. 4,911,619 A, 5,252,035 A, EP 0 386 320 A1 or EP 1 031 728 A1. In all cases, a filter is arranged in the suction muffler, the main task of this filter being the removal of oil and impurities contained in the suction gas, to prevent damage to the compression unit.

Based on the foregoing, it is the general object of the present invention to further improve noise damping.

SUMMARY OF THE INVENTION

With a suction muffler as mentioned in the introduction, this task is solved in that the filter has a sieve-like embodiment and that the flow path comprises at least one second filter also with a sieve-like embodiment.

The sieve-like embodiment of the filter means that the filter includes a screen of a relatively fine mesh, through which the suction gas flows. The screen can be made of metal wire or fibres or, of corresponding fibres of another material, for example plastic. The embodiment of the filter as a screen or a sieve has two effects.

First, the first filter, as in the known case, serves the purpose of retaining impurities which might damage the compressor if allowed to enter the compression chamber. Of course, also a certain oil separation effect is achieved, which is desired to prevent a high external oil circulation in the refrigerant circuit. It is desirable to retain as much oil as possible in the compressor to lubricate and cool the moving parts thereof. However, the high gas speed in this area only permits oil separation to a limited extent. If oil is still contained in the refrigerant flow, it will be entrained through the sieve. Secondly, however, the sieve-like embodiment of the filter has a substantial noise-damping effect. A noise damping through the first filter is primarily achieved in that the acoustic energy flow coming from the primary acoustic source, namely the valve system, is decreased by the reduction of the free cross-section in the outlet channel. However, a particularly effective noise damping is achieved due to the fact that a second filter, also with a sieve-like embodiment, is arranged in the suction gas flow. In principle, the second filter has a corresponding effect, as a dirt filter, as an oil separator and, in noise damping. However, the major advantage of the second filter is that it damps a second acoustic source inside the suction muffler. The second acoustic source generates noise caused by the refrigerant flow. The cooperation of the two sieves or screens ensures a noise damping which exceeds a pure doubling of the effect of one filter. The oil separation itself basically only requires one filter. The second filter (seen in the flow direction) also separates oil, however, the cooperation of the two filters with their sieve-like embodiment is particularly effective when it comes to noise damping.

It is preferred that the second filter be arranged in a section of the flow path which has one of the smallest effective flow cross-sections. In this section, the suction gas flow then has the highest speed. Channels with a relatively small diameter are passed by a turbulent refrigerant flow. The eddies thus appearing on the surfaces of the channel may cause the channel walls to oscillate, so that they emit acoustic waves. The sieve-like second filter changes the turbulent flow conditions on these surfaces in that it interrupts the turbulent eddy pattern. A vibration of the channel walls is thus minimised or prevented. This is particularly effective in such parts of the flow path which have a relatively small flow cross-section. The effective flow cross-section corresponds to the part of the channel cross-section through which the major part of the refrigerant mass flows.

Preferably, the second filter is allocated to a channel, whose end section is directed towards the first filter. A gas flow is thus generated which is directed towards the first filter. In this gas flow, however, turbulence and pressure waves are substantially damped. In the distance between the outlet of the channel and the first filter, only a small possibility remains for a renewed generation of pressure waves in the suction gas. However, such pressure waves are additionally weakened in the first filter.

Preferably, an insert is arranged in the housing, which separates an upper chamber from a lower chamber and which has a channel between the first chamber and the second chamber, the second filter being allocated to the channel. The formation of an insert in the housing is known per se from DE 199 23 734 A1. Additionally, the second filter is now provided on the tube part, which forms the channel through the insert. This channel is aligned with the outlet channel and the filter at the inlet of the outlet channel. With this embodiment, a sound damping has proved to be particularly effective.

Preferably, at least one filter is arranged on a front side of a channel. This facilitates manufacturing. The filter merely has to be placed on the front side of the channel and connected with the housing part adopting the channel.

It is particularly preferred that in the flow direction the front side is arranged on the inlet side. Through the directional change of the refrigerant flow in the end section of an inlet channel of the suction muffler, an effective flow cross-section occurs at the inlet of the channel, which is smaller than the geometrical cross-section of the channel. In a manner of speaking, the gas is "pushed to one side".

Therefore, it is particularly advantageous that the second filter is arranged on this front side of the channel facing the inlet. Firstly, here the effective flow cross-section is smallest; secondly turbulence in the complete subsequent channel section is damped. The filter is thus more effective at the channel inlet than it would have been at the channel outlet.

It is particularly preferred that the front side of the channel projects from the housing part, which defines the channel. This simplifies the manufacturing process. When projecting from the housing part, the front side is accessible from all sides. Particularly when automatic handling equipment is used in production, a technical advantage in respect to handling is obtained.

Preferably, the filter is adhered or welded onto a part holding it. This is a very simple production technique which requires no additional parts to fix the filter on the corresponding housing part.

It is also preferred that the first filter is arranged under an angle in relation to the front side of the outlet channel and the second filter is arranged in parallel to the front side of the channel. The different inclinations of the filters to their individual, connected flow channels cause an improved noise damping. Particularly the first filter can work with an improved oil separation effect.

Preferably, a third filter with a sieve-like embodiment is arranged in the flow path.

BRIEF DESCRIPTION OF THE DRAWINGS

In the following, the invention is described on the basis of a preferred embodiment in connection with the drawing, showing.

DETAILED DESCRIPTION OF THE PREFERRED EMBODIMENT

Figure 1:
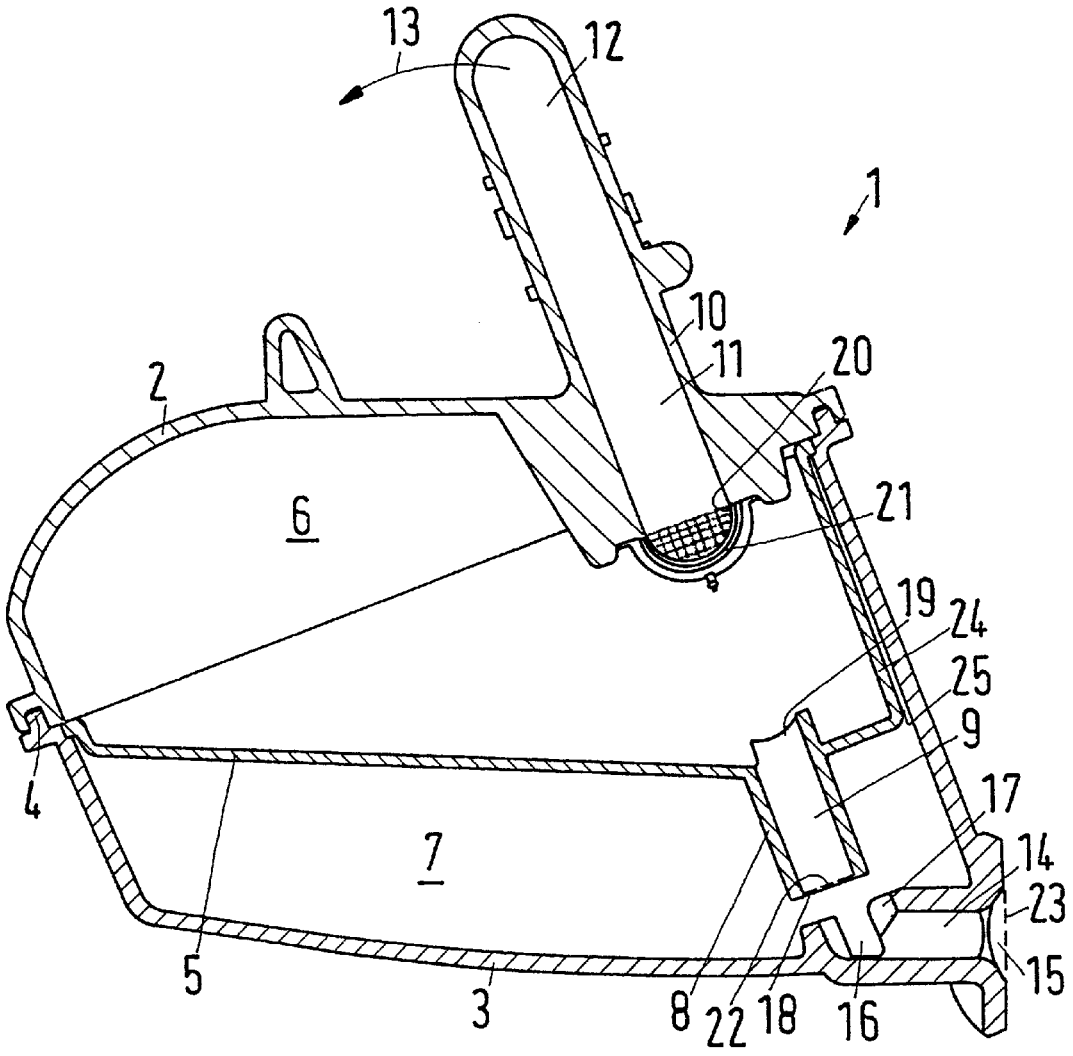
FIG. 1 schematically illustrates a cross-section through a suction muffler

As shown in FIG. 1, a suction muffler 1 for a hermetically enclosed compressor, particularly for a hermetically enclosed small refrigeration machine, has a housing, which is made of an upper part 2 and a lower part 3, which are connected with each other along a joint edge, for example by means of welding or gluing, however, the invention is not limited in this regard as fasteners can also be employed without departing from the broader aspect of the invention. Between the upper part 2 and the lower part 3 is arranged an insert 5, which divides the interior of the housing into an upper chamber 6 and a lower chamber 7. The insert 5 has a tube part 8, in which a channel 9 is formed, which connects the lower chamber 7 and the upper chamber 6 with each other.

The upper part 2 of the housing has a tube part 10, which projects outwardly and forms an outlet channel 11. An outlet opening 12 is formed at the end of the outlet channel 11, through which suction gas can enter a compressing unit, as symbolised by arrow 13.

In the lower part 3 an inlet channel 14 is formed, which is connected with an inlet opening 15.

The inlet channel has an end section 16, which is directed towards the channel 9 in the tube part 8 of the insert 5. However, the end section 16 has a larger flow cross-section than the channel 9. The channel 9, is directed towards the outlet channel 11, the outlet channel 11 having a larger flow cross-section than the channel 9. The outlet channel 11, the channel 9 and the end section 16 are approximately aligned relative to each other in such a way that their central axes lie on an approximately straight line or that they are at substantially least parallel to each other. This does not necessarily mean that an outlet opening 17 of the end section is parallel to the front side 18 on the inlet of the channel 9 or that an outlet opening 19 on the outlet of the channel 9 is parallel to a front side 20 of the outlet channel 11. On the contrary, the outlet openings 17, 19 can be partially limited by wall sections, which only extend partially in the circumferential direction. Accordingly, it is possible that gaseous refrigerant, which has entered through the inlet channel 14 or the channel 9, propagates in the lower chamber 7 and the upper chamber 6 after leaving the respective channels 14, 9.

On the front side 20 of the outlet channel 11 is arranged a filter 21 in the shape of a sieve or a screen. The filter 21 is inclined at an angle of approximately 45° in relation to the front side of the outlet channel 11. The sieve or the screen of the filter 21 is formed by a plurality of wires or fibres of metal or plastic or another material crossing each other. In addition to collecting impurities and separating oil, it also serves the purpose of damping noise.

On the front side 18 of the channel, a second filter 22 is arranged. The second filter 22 is also formed as a sieve or a screen having a fine mesh. The second filter 22 is planar.

Further, a third filter 23 may be provided on the inlet of the inlet channel 14, which also is in the shape of a sieve. However, sufficient noise damping qualities are already achieved, when only two filters are provided in the suction muffler.

It can be seen that all filters 21, 22, 23 are arranged on the front side openings of the respective channels. This facilitates handling during production. The corresponding filters merely have to be fitted on the front side of the channels 11, 9, 14 and can then be connected with the respective housing parts by means of gluing, welding or other methods. As the corresponding front sides project outwardly from the respective housing parts, little care needs to be taken when using handling equipment during production to prevent damaging other parts of the housing.

The insert 5 has a side wall 24, which forms a capillary gap 25 together with the lower part 3, in which gap lubricating oil can gather, and be retained there. In this way, an additional noise damping occurs. The second filter 22 supports the gathering of the oil.

Particularly through the cooperation of the second filter 22 on the inlet of the channel 9 with the first filter 21 on the inlet of the outlet channel 11 it is achieved that pressure waves, which can be generated in the gas flow, are weakened. During operation, these pressure waves are therefore not able to contribute to noises, which are disturbing for the environment.

What is claimed is:

1. A suction muffler for a hermetically sealed compressor comprising:

a housing having an inlet and an outlet;

means for defining a flow path between the inlet and the outlet to accommodate refrigerant coursing therethrough;

a first filter positioned in the outlet, at least a portion of the first filter defining a mesh through which the refrigerant can flow, the first filter acting to remove impurities from the refrigerant, to diffuse the refrigerant, and to attenuate noise generated from the flow of the refrigerant; and a second filter positioned in the flow path, at least a portion defining a mesh through which the refrigerant can flow, the second filter acting to damp an acoustic source in the housing, to remove impurities from the refrigerant, to diffuse the refrigerant, and to further attenuate noise generated from the flow of the refrigerant.

2. A suction muffler according to claim 1, wherein the second filter is arranged in a section of the flow path, having the smallest effective flow cross-section.

3. A suction muffler according to claim 1, wherein the second filter is positioned in a channel defining part of the flow path, the channel having an end section directed towards the first filter.

4. A suction muffler according to claim 1, further comprising an insert arranged in the housing, and separating the housing into an upper chamber and a lower chamber, the insert defining a channel between the first chamber and the second chamber, the second filter being positioned in the channel.

5. A suction muffler according to claim 4, wherein at least one of the first and second filters is arranged on a front side of one of a channel defined by the outlet and the channel between the first and second chamber.

6. A suction muffler according to claim 5, wherein with reference to the flow direction the front side faces the inlet.

7. A suction muffler according to claim 5, wherein the front side projects from the channel defining part.

8. A suction muffler according to claim 5, wherein at least one of the first and second filters is glued to a part holding it.

9. A suction muffler according to claim 4, wherein the first filter is arranged at an angle relative to a front side of the outlet and the second filter is arranged approximately parallel to a front side of the channel between the upper chamber and the lower chamber.

10. A suction muffler according to claim 1, further comprising a third filter having a mesh arranged in the flow path.

11. A suction muffler according to claim 5, wherein at least one of the first and second filters is welded to a part holding it.

* * * * *